US012753983B2

(12) United States Patent
Herring et al.

(10) Patent No.: US 12,753,983 B2
(45) Date of Patent: Oct. 6, 2026

(54) LEVER-ACTION FIREARM AND KIT FOR CONSTRUCTING THE SAME

(71) Applicant: Ares Defense Systems, Inc., Melbourne, FL (US)

(72) Inventors: Geoffrey A Herring, Melbourne, FL (US); Nathaniel T. Fitch, Titusville, FL (US)

(73) Assignee: Ares Defense Systems, Inc., Melbourne, FL (US)

( * ) Notice: Subject to any disclaimer, the term of this patent is extended or adjusted under 35 U.S.C. 154(b) by 20 days.

(21) Appl. No.: 18/896,530

(22) Filed: Sep. 25, 2024

(65) Prior Publication Data

US 2025/0327635 A1 Oct. 23, 2025

Related U.S. Application Data

(63) Continuation of application No. 18/161,057, filed on Jan. 28, 2023, now Pat. No. 12,152,844.

(Continued)

(51) Int. Cl.
*F41A 11/02* (2006.01)
*F41C 7/06* (2006.01)

(52) U.S. Cl.
CPC ..... *F41A 11/02* (2013.01); *F41C 7/06* (2013.01)

(58) Field of Classification Search
CPC ..... F41A 3/22; F41A 3/24; F41A 3/26; F41C 7/06

(Continued)

(56) References Cited

U.S. PATENT DOCUMENTS 2,484,694 A 10/1949 Dicke
2,606,383 A 8/1952 Jensen (Continued)

FOREIGN PATENT DOCUMENTS

EP 3203178 A1 8/2017
WO 9725580 7/1997

OTHER PUBLICATIONS

"Lever Action AR-15—Red Ryd-AR Theme Build—(PSA Christmas-15 lower) (p. 1 of 5)" .ar15.com, https://www.ar15.com/forums/general/Lever-Action-AR-15--Red-Ryd-AR-Theme-Build---PSA-CHRISTMAS-15-lower-/5-2264164/, Oct. 16, 2019, Accessed on Jan. 24, 2024.

(Continued)

*Primary Examiner* — Troy Chambers
*Assistant Examiner* — Benjamin S Gomberg
(74) *Attorney, Agent, or Firm* — David O. Simmons; IVC Patent Agency

(57) ABSTRACT

A receiver system comprises upper and lower receiver bodies, a lower receiver body, a bolt carrier, and an action-control lever. The upper receiver body is a semi-automatic firearm upper receiver body. The lower receiver body includes a stock mounting flange having a stock receptacle that is matingly engageable with a receiver engaging portion of a stock. The bolt carrier is slidably disposed within a bolt carrier receiving bore of the upper receiver body. The action-control lever has a hand loop and a first attachment arm having a proximate end portion thereof attached to the hand loop. The first attachment arm is pivotably attached at a distal end thereof to the lower receiver body for being pivoted between a battery-ready position and a cartridge-ejecting position relative to the lower receiver body. The action-control lever is attached to the bolt carrier through an articulating coupling assembly.

31 Claims, 12 Drawing Sheets

Related U.S. Application Data

(60) Provisional application No. 63/405,309, filed on Sep. 9, 2022.

(58) Field of Classification Search
USPC ..... 42/16
See application file for complete search history.

(56) References Cited

U.S. PATENT DOCUMENTS

| | | | | |
|---|---|---|---|---|
| 2,765,559 | A | 10/1956 | Morris | |
| 2,777,234 | A | 1/1957 | Neal | |
| 2,881,547 | A | 4/1959 | Butler | |
| 3,035,495 | A | 5/1962 | Stoner | |
| 3,092,924 | A | 6/1963 | Seecamp | |
| 3,198,076 | A | 8/1965 | Stoner | |
| 3,287,842 | A | 11/1966 | Smith | |
| 3,377,731 | A | 4/1968 | Lawrence | |
| 5,173,564 | A | 12/1992 | Hammond | |
| 5,758,444 | A * | 6/1998 | Ruger | F41A 3/32 42/16 |
| 5,900,577 | A | 5/1999 | Robinson et al. | |
| 6,293,040 | B1 | 9/2001 | Luth | |
| 7,444,775 | B1 | 11/2008 | Schuetz | |
| 9,068,786 | B2 | 6/2015 | DiChario | |
| 9,328,990 | B2 * | 5/2016 | Giannelli | F41C 7/06 |
| 9,459,060 | B2 | 10/2016 | Langevin et al. | |
| 9,823,031 | B2 | 11/2017 | Robbins et al. | |
| 9,897,410 | B1 * | 2/2018 | Tarip | F41C 7/06 |
| 11,988,480 | B2 * | 5/2024 | Tusting | F41C 7/06 |
| 12,152,844 | B2 * | 11/2024 | Herring | F41A 11/02 |
| 12,442,603 | B2 * | 10/2025 | Moore | F41A 3/72 |
| 2006/0283067 | A1 | 12/2006 | Herring | |
| 2017/0227318 | A1 * | 8/2017 | Yaka | F41A 3/12 |
| 2021/0293498 | A1 | 9/2021 | Underwood et al. | |
| 2023/0304755 | A1 | 9/2023 | Tusting et al. | |

OTHER PUBLICATIONS

Gun Mart TV, Southern Gun Co. 9mm Lever Action Rifle, Youtube, https://www.youtube.com/watch?v=UIOpRPolaOs, Dec. 21, 2020, Accessed on Jan. 23, 2024.

Gun Mart TV, Southern Gun Co Lever Action Rifle 9mm Part II, Youtube, https://www.youtube.com/watch?v=mxTMdiSP-2E, Jan. 15, 2021, Accessed on Jan. 21, 2024.

Kurylyk Z., "Lever action: The next tactical frontier?" Calibre: The Canadian Firearms Magazine, https://calibremag.ca/lever-action-the-next-tactical-frontier/, Mar. 9, 2021, Accessed on Dec. 29, 2023.

Brickwurx Mfg., "Brickwurx Mfg. Lever Action AR-15, Initial Cycle Test (Red Ryd / Christmas-15)," YouTube, https://www.youtube.com/watch?v=SbXWqatpito, Aug. 16, 2019, Accessed on Dec. 29, 2023.

Firearms Manual: Tombstone [On-Line]. 2022, [Retrieved on Jan. 28, 2023], Retrieved from Internet: <https://pof-usa.com/wp-content/uploads/2022/11/OWNMAN-TOMBSTONE-WEB.pdf >.

Bond Arms Lever-Action (Coming Soon) [On-Line]. 2023, [Retrieved on Jan. 28, 2023], Retrieved from Internet: <https://www.bondarms.com/Bond-Arms-Lever-Action-Coming-Soon-P8583.aspx#descPane >.

International Search Authority, Notification of Transmittal of the International Search Report and Written Opinion of the International Search Authority, PCT/US2023/072759, 24 pages.

* cited by examiner

LEVER-ACTION FIREARM AND KIT FOR CONSTRUCTING THE SAME

CROSS-REFERENCE TO RELATED APPLICATIONS

This continuation patent application claims priority to co-pending U.S. non-provisional patent application Ser. No. 18/161,057 filed 28 Jan. 2023 entitled "LEVER-ACTION FIREARM AND KIT FOR CONSTRUCTING THE SAME," which claim priority to co-pending United States provisional patent application having Ser. No. 63/405,309 filed 9 Sep. 2022 entitled "CALIBER AND MAGAZINE CONVERTIBLE MODULAR LEVER-ACTION FIREARM AND KIT FOR CONSTRUCTING THE SAME," each application having a common applicant herewith and are being incorporated herein in their entirety by reference.

FIELD OF THE DISCLOSURE

The disclosures made herein relate generally to firearms and methods of manufacture thereof and, more particularly, to firearms that are manually actuated by a user via a pivotable lever that is engaged with both a receiver body of the firearm and with a bolt carrier of the firearm.

BACKGROUND

Lever-action firearms, which are typically in the form of a rifle, are well known to a person of ordinary skill in the art of firearms (i.e., a skilled person). Similarly, operation of a lever-action firearm is well known to a skilled person. For example, in general, operation of a lever-action rifle entails a user manually rotating a lever beneath the action in a first direction (i.e., away from an at-rest position where a hand-gripping portion of the lever is adjacent a stock of the rifle) for causing the breach bolt (e.g., as mounted on a bolt carrier) to cycle to the rear to extract a fired cartridge case, followed by the user manually rotating the lever in a second direction opposite the first direction to urge the bolt forward, whereby it feeds a cartridge into the chamber and locks the bolt into battery to ready the rifle for firing. The advent of the lever-action rifle (i.e., traditional lever-action rifle) was significant in that it afforded a rifle offering rapid chambering and firing of several successive cartridges and faster reload than earlier single-shot and muzzle-loading muskets and rifles. Some traditional lever-action rifles were caliber compatible with the single-action revolvers of the era, thereby enhancing logistics and permitting ammunition sharing between revolver side arm and lever-action rifles.

A skilled person will understand that conventional lever-action firearms (i.e., traditional and those offered since) are known to have shortcomings associated with their structural design—e.g., having a fixed ammunition configuration, having a thin-walled tubular magazine design, having a fixed ammunition capacity, and the like. Such fixed ammunition configuration (e.g., caliber and cartridge configuration) is a shortcoming because the firearm is dedicated to a given ammunition regardless of ammunition availability, suitability of that specific ammunition for an anticipated task, or simply the user's desire to have his or her firearm in another ammunition (e.g., caliber) configuration. The elongated, thin-walled, tubular (i.e., sleeve-like) magazine of conventional lever-action firearms is externally disposed beneath the firearm's barrel in a generally unprotected manner. As such, one shortcoming of the magazine of conventional lever-action firearms is being easily damaged from contact with an object. Such damage renders the firearm inoperable for current service until the magazine is replaced, which can be a lengthy process as the magazine of a conventional lever-action firearm is not implemented in a manner that allows for its rapid replacement (or repair). Another shortcoming of the magazine of conventional lever-action firearms arises from the center of gravity of the firearm changing as available ammunition stored end-to-end along a length of the magazine is depleted through use. Possibly the most significant shortcoming is that the aforementioned end-to-end orientation of ammunition within the magazine requires ammunition to have a round-nose or blunt-nose projectile due to the risk of the projectile of one round of ammunition igniting the center-fire primer of a round of ammunition with which the projectile is in abutting engagement within the magazine. This unintentional primer ignition is of particular concern in situations where the firearm is dropped on its end or subjected to linear recoil motion when the gun is fired.

Conventional lever-action firearms have the operational shortcoming in that they can be slow, cumbersome, and potentially dangerous to unload. Unloading the magazine of a conventional lever-action firearm generally entails manually chambering and ejecting each round of ammunition one after the other until all rounds of ammunition have been removed from the magazine and the chamber. These actions introduce increased wear on the firearm and ammunition, may lead to potential damage to the ammunition as it is chambered and ejected, and potentially may result in accidental discharge.

Yet other shortcomings of conventional lever-action firearms may arise from being designed to have attractive aesthetics. Examples of these aesthetic considerations include fine wooden stocks, highly polished blued metal surfaces, and the like. While aesthetically pleasing, such aesthetic features often result in a firearm (lever-action or otherwise) having durability issues as a result of use in poor weather conditions and in other use situations considered to be hard or extreme in regard to aesthetic considerations. Relatedly, components of conventional lever-action firearms may suffer from shortcomings resulting from lack of availability and interchangeability of replacement components such as due to, for example, certain components being hand-fitted upon final assembly during original assembly of the firearm.

Still further, conventional lever-action firearms may have the shortcoming of being designed in a manner in which their actions and bolt groups are readily or easily exposed to dirt, debris, and other contaminants. For example, the actions and bolt groups of conventional lever-action firearms often protrude in an exposed manner from a rear portion of the firearm. The exposed nature of these components can result in their damage or in their unintended actuation or operation thereby damaging the firearm, creating a potentially dangerous or fatal condition, or both.

As ammunition technology evolved under the influence of ammunition designers like notable ammunition expert Charles Newton, chamber pressures increased and the ogive shape of the projectile sharpened to a point to reduce drag and enhance aerodynamic stability for increased projectile accuracy and velocity. Yet, traditional lever-action firearms with tubular magazines disposed beneath the barrel were not compatible with pointed projectiles due to the risks stated previously herein related to unintended primer ignition. Such undesirable characteristics undoubtedly led firearm designers to invent other means of storing a plurality of ammunition within a lever-action firearm (e.g., a box-type, a rotary magazine, etc.) in order to capitalize on evolving high-velocity ammunition.

A skilled person will know that endeavors to produce viable lever-action firearms that can accommodate pointed (e.g., spitzer-pointed) ammunition have been undertaken with varying degrees of success. These prior endeavors are known to entail use of a box-type or rotary ammunition magazine that is loaded through the action with the breech bolt retracted. These types of magazines solved the issue of unintended primer ignition associated with tubular magazines and they permitted pointed ammunition to be used. However, because these types of magazines are effectively non-detachable from the firearm, they are limited in their service use in regard to critical service situations such as, for example, self-defense, law enforcement and military applications. Additionally, because these types of magazines are loaded from above the action, they generally prohibit the attachment of optical scopes or sights above the action of the firearm.

Therefore, implementing a lever-action firearm in a manner that overcomes shortcomings associated with conventional lever-action firearms would be advantageous, desirable, and useful.

SUMMARY OF THE DISCLOSURE

Embodiments of the disclosures made herein are directed to an improved implementation of a lever-action firearm. Specifically, this improved implementation of a lever-action firearm overcomes shortcomings of conventional lever-action firearms. These shortcomings are known to arise from considerations associated with the underlying structural design of conventional lever-action firearms, their mechanical operation, and their aesthetic design. By overcoming these shortcomings, firearms configured in accordance with embodiments of the disclosures made herein exhibit superior durability, operability, and functionality in comparison to conventional lever-action firearms. Lever-action firearms configured in accordance with embodiments of the disclosures made herein retain the use operation of a conventional lever-action firearm as disclosed above.

Firearms configured in accordance with embodiments of the disclosures made herein include an improved receiver system in comparison to that of conventional lever-action firearms. In certain embodiments, this improved receiver system may be characterized as having a bolt carrier group arrangement, a magazine arrangement, an ammunition feed arrangement, and a trigger assembly arrangement typical of a rifle capable of operating in semi-automatic mode, automatic mode, or both. AR-15 platform rifles are an example of rifles well-known to be operable in semi-automatic mode and M16 platform carbines are an example of rifles well-known to be operable in automatic mode.

The improved receiver system of firearms configured in accordance with embodiments of the disclosures made herein may be characterized by structural aspects commonly found in weapons subject to extreme duty—e.g., hard combat use in all-weather conditions. One example of such a structural aspect is that the receiver system may include mating upper and lower receiver bodies where the upper receiver body preferably carries a bolt carrier group of the firearm, and the lower receiver body preferably carries a trigger assembly of the firearm. Jointly, the upper and lower receiver bodies form a receiver body unit to which a barrel and a stock of the firearm may be mounted. Another example of such a structural aspect is that the receiver bodies may be configured in accordance with a firearm platform (e.g., the AR-15 platform) that offers a myriad of chambering options, a component arrangement that is well-known to be durable, reliable and efficient, and a magazine well arrangement that readily supports compatibility with magazines corresponding to a given chambering configuration. Still another example of such a structural aspect is that the receiver bodies may be made from lightweight metal alloy material (e.g., aluminum) that has been surface finished in a manner that adds durability in regard to surface material hardness and resistance to wear and degradation (e.g., hard-coat anodized).

In one or more embodiments of the disclosures made herein, a receiver system for a lever-action rifle comprises a receiver body system, a bolt carrier, and an action-control lever. The receiver body system includes an upper receiver body and a lower receiver body matingly attached to the upper receiver body. The upper receiver body is a semi-automatic rifle upper receiver body that was commercially-available prior to the year 2022 AD. A rear end portion of the lower receiver body includes an accessory mounting interface. The accessory mounting flange includes an accessory receptacle that is compatible for being matingly engaged with a receiver engaging portion of a stock directly mountable on a shotgun that was commercially-available prior to the year 2022 AD. The bolt carrier is slidably disposed within a bolt carrier receiving bore of the upper receiver body. The action-control lever has a hand loop and a first attachment arm having a proximate end portion thereof attached to the hand loop. A distal end portion of the first attachment arm is pivotably attached to the lower receiver body for enabling the hand loop to pivot between a battery-ready position and a cartridge-ejecting position relative to the lower receiver body. The hand loop is attached to the bolt carrier through a coupling assembly. The hand loop and the coupling assembly are jointly configured such that moving the hand loop between the battery-ready position and the cartridge-ejecting position causes the bolt carrier to correspondingly slide within the bolt carrier receiving bore between a battery position and an ejection position.

In one or more embodiments of the disclosures made herein, a firearm comprises a receiver body system, a bolt carrier, a linkage member, and an action-control lever. The receiver body system includes an upper receiver body, a lower receiver body detachably attached to the upper receiver body, and a trigger assembly mounted on the lower receiver body. The upper receiver body is an AR-15 platform compatible upper receiver body having a bolt carrier receiving bore therein. The trigger assembly and the lower receiver body are jointly configured such that a trigger of the trigger assembly is located directly beneath an accessory mounting flange of the lower receiver body. The bolt carrier is slidably disposed within the bolt carrier receiving bore. The linkage member has a first end portion and a second end portion. The first end portion of the linkage member is pivotably attached to the bolt carrier. The action-control lever has a hand loop, a first attachment arm, and a second attachment arm. The first attachment arm has a proximate end portion thereof attached to the hand loop.

The second attachment arm has a proximate end portion thereof attached to the hand loop. A distal end portion of the first attachment arm is pivotably attached to the lower receiver body for enabling the action-control lever to pivot between a battery-ready position and a cartridge-ejecting position. The second attachment arm extends through the accessory mounting flange with the action-control lever in the battery-ready position. A distal end portion of the second attachment arm is pivotably attached to a second end portion of the linkage.

In one or more embodiments of the disclosures made herein, a kit for assembling a firearm comprises a linkage member, a bolt carrier, a lower receiver body, and an action-control lever. The linkage member includes a bolt carrier engaging end portion and an action-control lever engaging end portion. The bolt carrier has a linkage member structure engaging portion at a rear end portion thereof. The linkage member structure engaging portion of the bolt carrier and the bolt carrier engaging end portion of the linkage member are jointly configured to permit the bolt carrier engaging end portion of the linkage member to be pivotably attached to the linkage member structure engaging portion of the bolt carrier. The lower receiver body includes engagement surfaces and at least a rear takedown pin bore enabling the lower receiver body to be matingly attached to the AR-15 platform compatible upper receiver body. A rear end portion of the lower receiver body includes an accessory mounting flange. The action-control lever includes a hand loop, a first attachment arm having a proximate end portion thereof attached to the hand loop, and a second attachment arm having a proximate end portion thereof attached to the hand loop. A distal end portion of the first attachment arm and a lever mounting portion of the lower receiver body are jointly configured to permit the distal end portion of the first attachment arm to be pivotably attached to the lever mounting portion of the lower receiver body for enabling the action-control lever to pivot between a battery-ready position and a cartridge-ejecting position relative to the lower receiver body. The second attachment arm and the lower receiver body are jointly configured such that the second attachment arm extends through the accessory mounting flange with the action-control lever in the battery-ready position.

In some embodiments of the disclosures made herein, the upper receiver body is an AR-15 platform compatible upper receiver body.

In some embodiments of the disclosures made herein, the shotgun is one of a Remington brand shotgun, a Winchester brand shotgun and a Mossberg brand shotgun.

In some embodiments of the disclosures made herein, the action-control lever and the lower receiver body jointly define a fully-enclosed trigger finger window with the action-control lever in the battery-ready position.

In some embodiments of the disclosures made herein, the distal end portion of the first attachment arm is pivotably attached to a portion of the lower receiver body that partially defines the fully-enclosed trigger finger window.

In some embodiments of the disclosures made herein, an accessory securement body has spaced-apart engagement shoulders.

In some embodiments of the disclosures made herein, the accessory mounting flange includes opposing shoulder-receiving receptacles within a central passage thereof and the spaced-apart engagement shoulders and the opposing shoulder-receiving receptacles are jointly configured for permitting each of the spaced-apart engagement shoulders to be engaged within a respective one of the opposing shoulder-receiving receptacles to inhibit unrestricted fore and aft movement of the accessory securement body relative to the lower receiver body.

In some embodiments of the disclosures made herein, a trigger assembly is mounted on the lower receiver body.

In some embodiments of the disclosures made herein, the upper receiver body is an AR-15 platform compatible upper receiver body, the lower receiver body has engagement surfaces and at least a rear takedown pin bore enabling the lower receiver body to be matingly attached to the AR-15 platform compatible upper receiver body, and the lower receiver includes a magazine well that defines a frontal end portion thereof.

In some embodiments of the disclosures made herein, a linkage member has a first end portion pivotably attached to the bolt carrier.

In some embodiments of the disclosures made herein, the action-control lever includes a second attachment arm having a proximate end portion thereof attached to the hand loop, the linkage member and the second attachment arm jointly define the coupling assembly, the second attachment arm extends through an accessory mounting flange of the lower receiver body with the action-control lever in the battery-ready position, and a second end portion of the linkage member is pivotably attached to a distal end portion of the second attachment arm.

In some embodiments of the disclosures made herein, the accessory mounting flange includes an accessory receptacle and the second attachment arm of the action-control lever extends through a central area of the accessory receptacle.

In some embodiments of the disclosures made herein, a firing pin is slidably disposed within a mating passage of a bolt carried by the bolt carrier.

In some embodiments of the disclosures made herein, a central portion of the linkage member between the first and second end portions thereof has a hammer-receiving space therein and a head of the firing pin is located below the hammer-receiving space.

In some embodiments of the disclosures made herein, the hammer-receiving space is one of a hammer-receiving channel within a lower surface of the linkage member and a hammer-receiving passage extending through upper and lower surfaces of the linkage member.

In some embodiments of the disclosures made herein, the second attachment arm includes an arcuate segment between the distal end portion thereof and the hand loop, the arcuate segment extends along an arcuate axis, and all points along the arcuate axis are equidistant from a pivot axis about which the action-control lever pivots between the battery-ready position and the cartridge-ejecting position.

In some embodiments of the disclosures made herein, an accessory securement body is attached to the accessory mounting flange.

In some embodiments of the disclosures made herein, the accessory securement body includes a channel in a lower portion thereof and a portion of the arcuate segment of the second attachment arm is located within the channel when the hand lever is in the battery-ready position.

These and other objects, embodiments, advantages and/or distinctions of the present invention will become readily apparent upon further review of the following specification, associated drawings and appended claims.

DETAILED DESCRIPTION

Drawing FIGS. 1-16 depict various structural and functional aspects of lever-action firearms in accordance with embodiments of the disclosures made. These structural and functional aspects are advantageous in that they overcome shortcomings associated with conventional lever-action firearms. Structural aspects of such firearms may include a receiver system characterized as having one or more of a bolt carrier group arrangement, a magazine arrangement, an ammunition feed arrangement, and a trigger assembly arrangement typical of a firearm (e.g., a rifle) capable of operating in semi-automatic mode, automatic mode, or both (e.g., AR-15 platform rifles, M16 platform carbines, and the like). Structural aspects of such firearms may also include a receiver system characterized as being configured for having an accessory (e.g., a shotgun stock) mounted thereon. As set forth herein, such structural aspects may be implemented in respective manners that beneficially impact various functional characteristics of a lever action firearm. Examples of these characteristics include, but may not be limited to, operational efficiency and reliability, structural reliability, structural and operational simplicity, physical and aesthetic durability, chambering convertibility, and combinations thereof.

Figure 1:
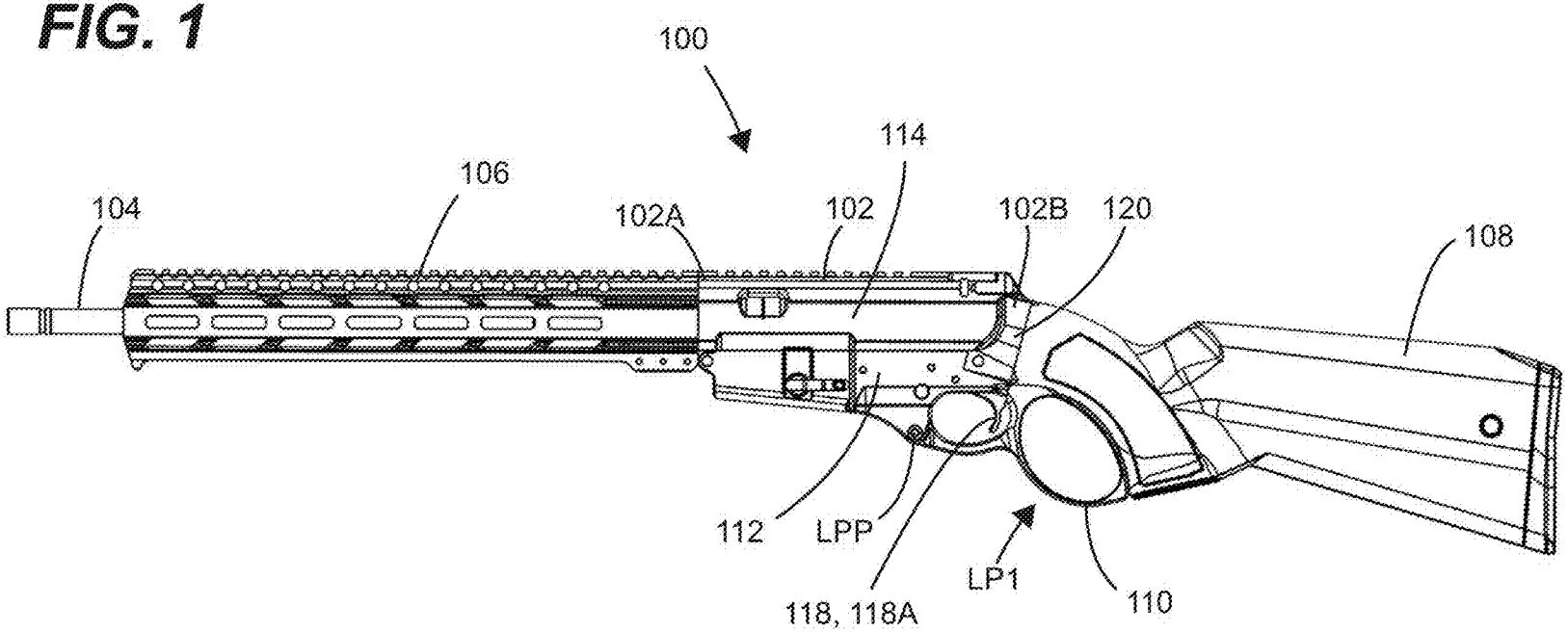
FIG. 1 is a side view of a lever-action rifle configured in accordance with one or more embodiments of the disclosures made herein, with an action-control lever thereof in a battery-ready position.
Figure 2:
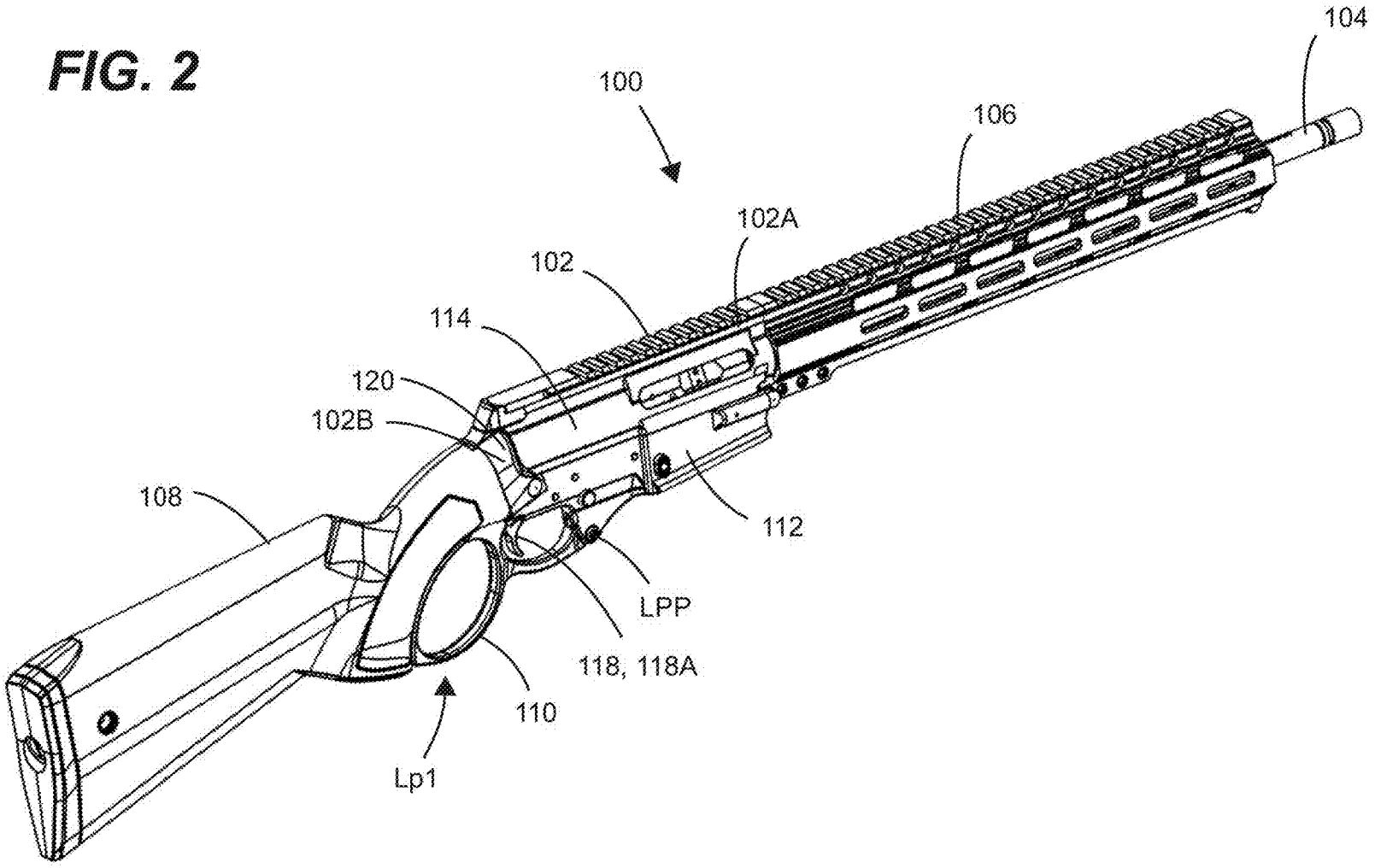
FIG. 2 is a first perspective view of the rifle of FIG. 1, with the action-control lever thereof in the battery-ready position.
Figure 3:
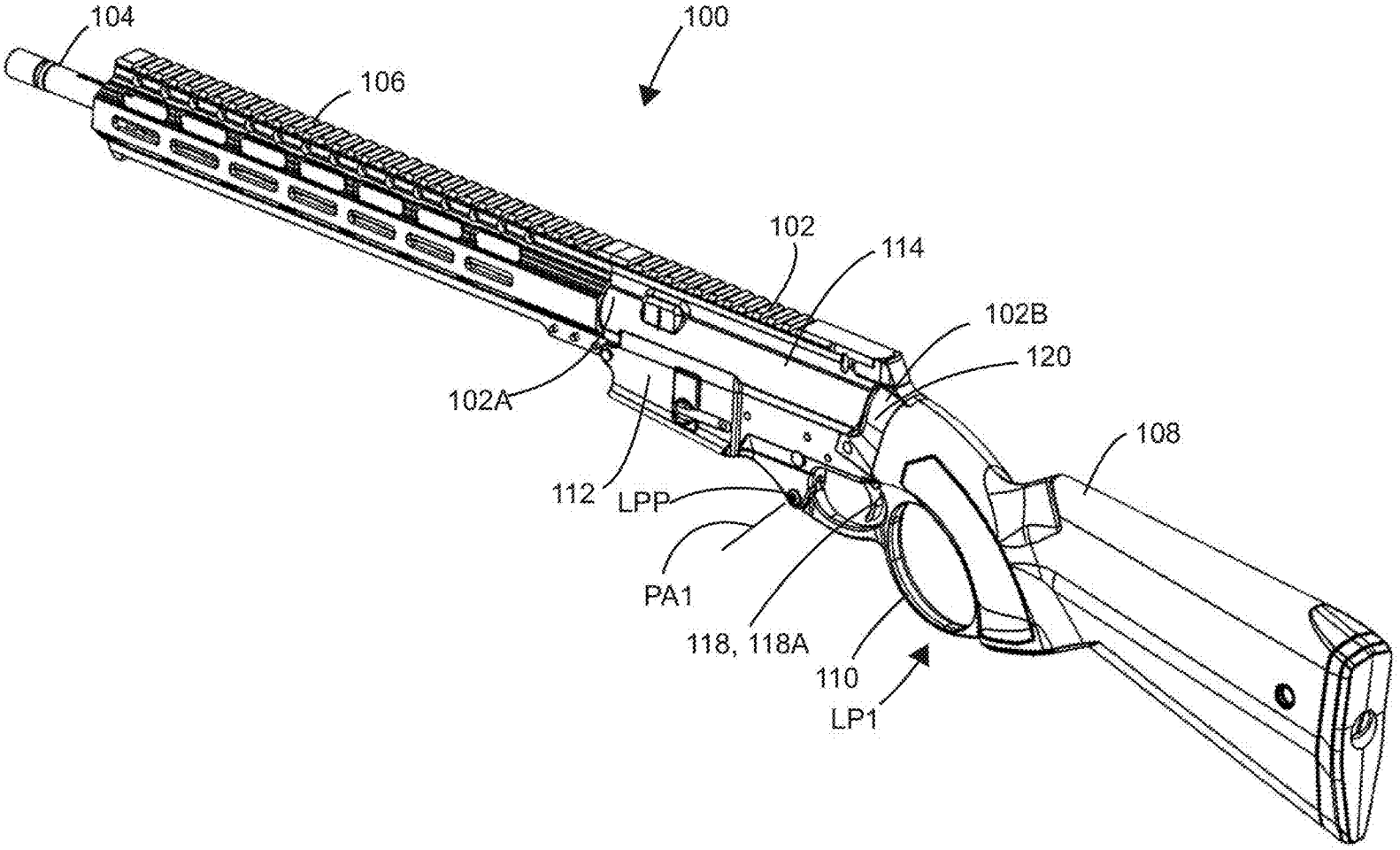
FIG. 3 is a second perspective view of the rifle of FIG. 1, with the action-control lever thereof in the battery-ready position.
Figure 4:
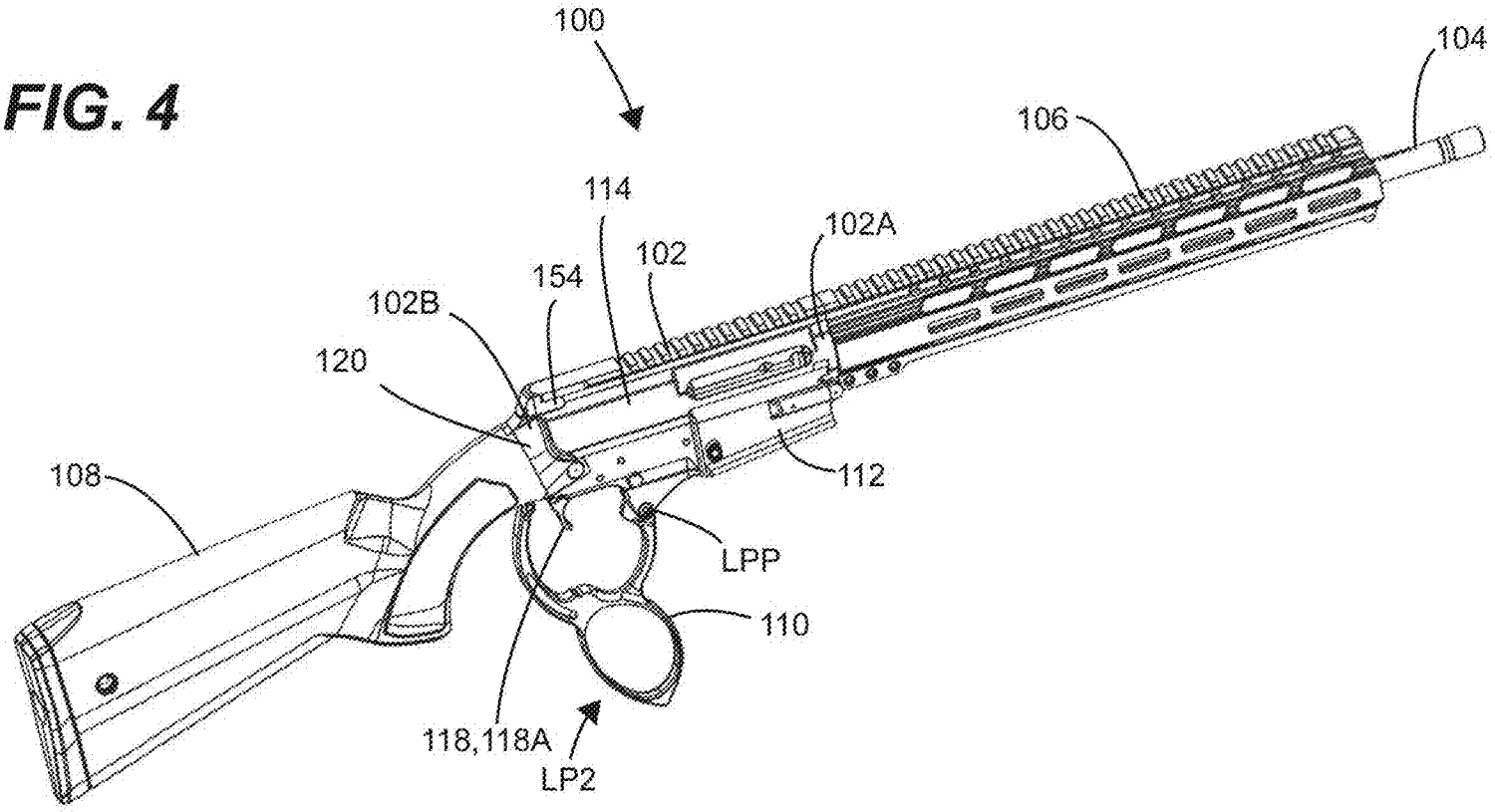
FIG. 4 is a third perspective view of the rifle of FIG. 1, with the action-control lever thereof in a cartridge-ejecting position.

FIGS. 1-4 show a lever-action firearm in accordance with one or more embodiments of the disclosures made herein (i.e., rifle 100). The rifle 100 includes a receiver system 102, a barrel 104, a handguard 106, a stock 108 (i.e., an accessory), and an action-control lever 110. While a stock is one example of an accessory engageable with a rear portion of a receiver body of a firearm, other examples of such an accessory include, but are not limited to, grips, pistol grips, stocks, stabilizing braces, and other accessories that enable stabilization at the rear end of the receiver system 102. The barrel 104 and the handguard 106 are attached to a front end portion 102A of the receiver system 102. The stock 108 is attached to a rearend portion 102B of the receiver system 102. The action-control lever 110 is attached to the receiver system 102 at a lever pivot point LPP in a manner allowing the action-control lever 110 to be pivoted between a battery-ready position LP1 and a cartridge-ejecting position LP2 relative to the receiver system 102. As best shown in FIG. 3, the lever pivot point PP1 defines a pivot axis PA1 about which the action-control lever 110 is constrained to pivot. Various components of the receiver system 102 (as well as components other than those of the receiver system 102) may be offered in kit form for enabling assembly of a firearm in accordance with one or more embodiments of the disclosures made herein.

Figure 5:
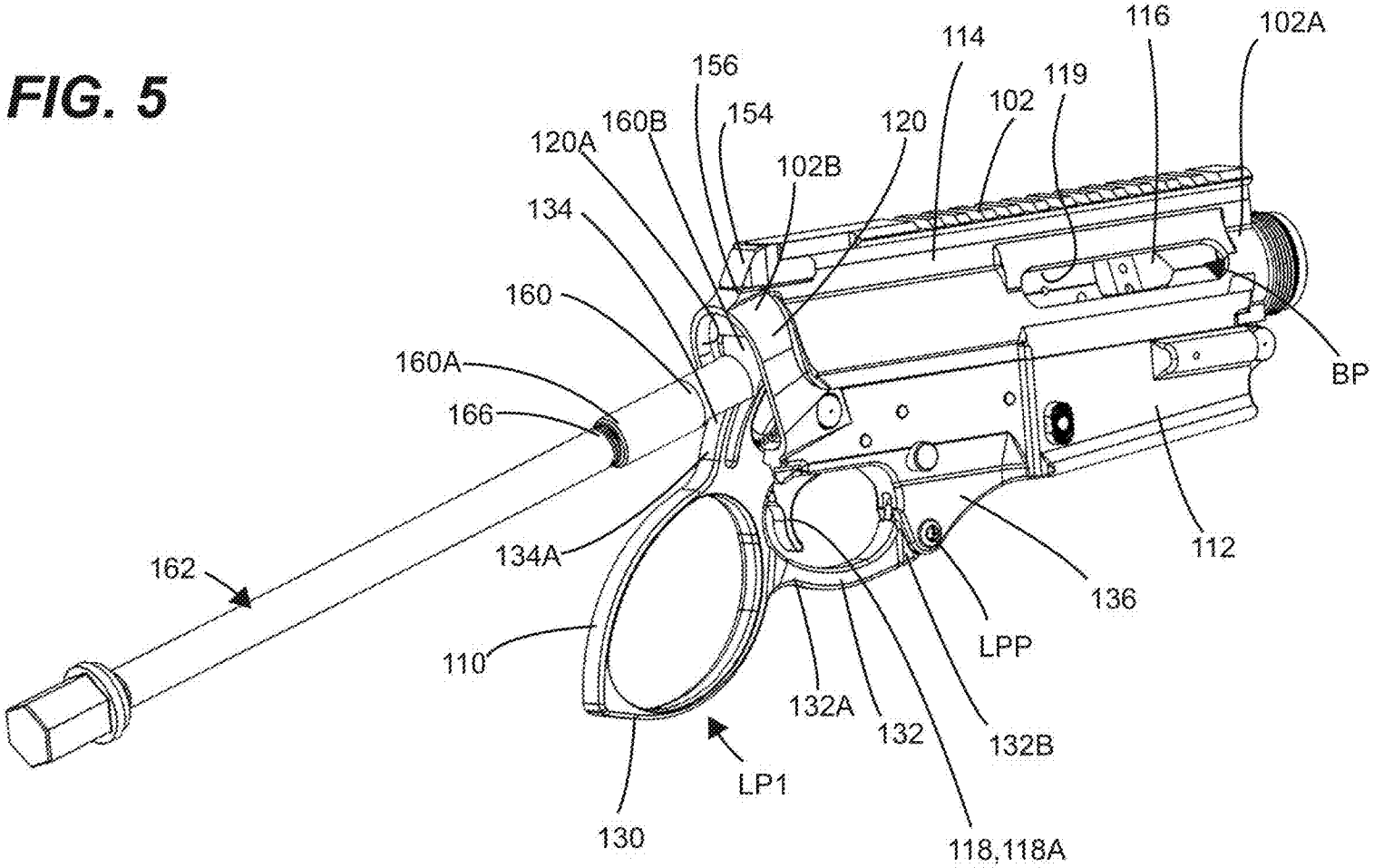
FIG. 5 is a perspective view showing a receiver system and accessory mounting components of the rifle of FIG. 1, with the action-control lever thereof in the battery-ready position.
Figure 6:
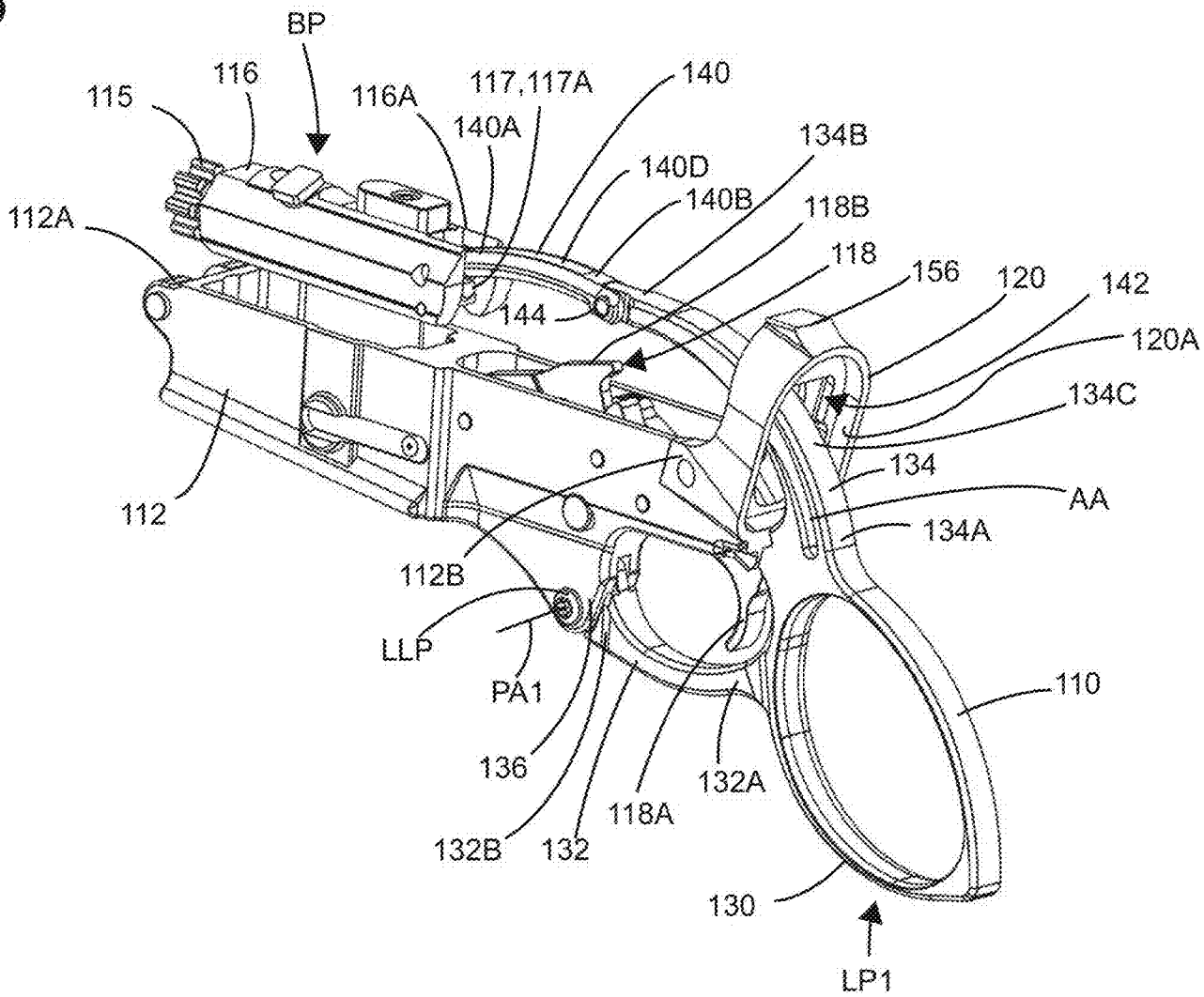
FIG. 6 is a first perspective view showing aspects of a lower receiver body, a carrier group, a linkage member, the action-control lever and a trigger assembly of the rifle of FIG. 1, with the action-control lever thereof in the battery-ready position.

Referring now to FIGS. 1-12, the receiver system 102 includes a lower receiver body 112, an upper receiver body 114, a bolt carrier 116 and a trigger assembly 118. The lower receiver body 112 and the upper receiver body 114 are operably attached to each other by a means that is well known in the art. The trigger assembly 118 is attached to the lower receiver body 112. The bolt carrier 116 is slidably disposed within a bolt carrier receiving bore 119 of the upper receiver body 114. As shown in FIG. 6, a firing pin 117 is slidably disposed within a mating passage of a bolt 115 carried by the bolt carrier 116. The lower receiver body 112 and the trigger assembly 118 are jointly configured such that a trigger 118A of the trigger assembly 118 is located directly (vertically) beneath a stock mounting flange 120 of the lower receiver body 112, thereby allowing the trigger 118A to be in a suitable position relative to the stock 108 of a shotgun.

As best shown in FIGS. 5-12, in preferred embodiments, the lower receiver body 112 and the upper receiver body 114 may be configured in accordance with the AR-15 platform. In some embodiments, the upper receiver body 114 is an AR-15 platform compatible upper receiver body that was commercially-available prior to the year 2022 AD and the lower receiver body 112 is an AR-15 platform compatible lower receiver that is lever-action specific in accordance with the disclosures made herein. As is well known in the art, when configured in accordance with the AR-15 platform, the lower receiver body 112 has spaced-apart front lugs 112A and spaced-apart rear lugs 112B and the upper receiver body 114 has a front lug 114A and a rear lugs 114B. The front and rear lugs 114A, 114B of the upper receiver body 114 matingly and respectively engage the front and rear lugs 112A, 112B of the lower receiver body 112. The front and rear lugs 112A, 112B of the lower receiver body 112 and the front and a rear lug 114A, 114B of the upper receiver body 114 carry respective takedown pin bores (square, round, oval, squared-oval cross-sectional profiles or otherwise) for receiving a respective takedown pin. Additionally, the lower receiver body 112 has upper and rear surfaces that matingly and respectively engage lower and rear surfaces of the upper receiver body 114 whereby such engagement surfaces are each an engagement surface of a respective receiver body (e.g., the lower receiver body 112) that engage a respective and mating engagement surface of the other receiver body (e.g., the upper receiver body 114).

The upper engagement surfaces of the lower receiver body 112 are defined by a trigger assembly well 121 (i.e., a rearend portion of the lower receiver body 112) and magazine well 122 (i.e., a frontend portion of the lower receiver body 112). The rear engagement surfaces of the lower receiver body 112 are defined by the stock mounting flange 120.

Figure 7:
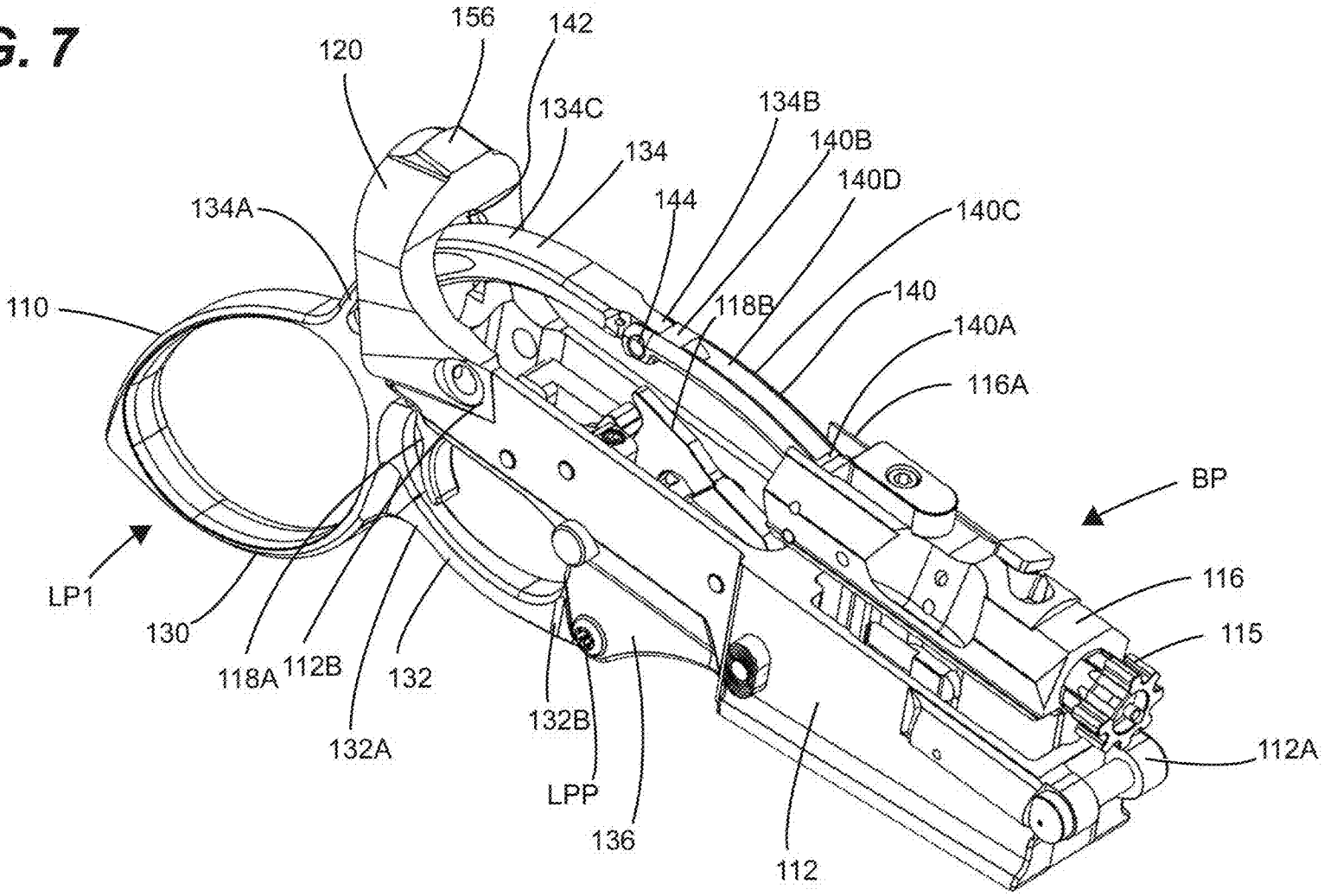
FIG. 7 is a second perspective view showing aspects of the lower receiver body, the carrier group, the linkage member, the action-control lever and the trigger assembly of the rifle of FIG. 1, with the action-control lever thereof in the battery-ready position.
Figure 8:
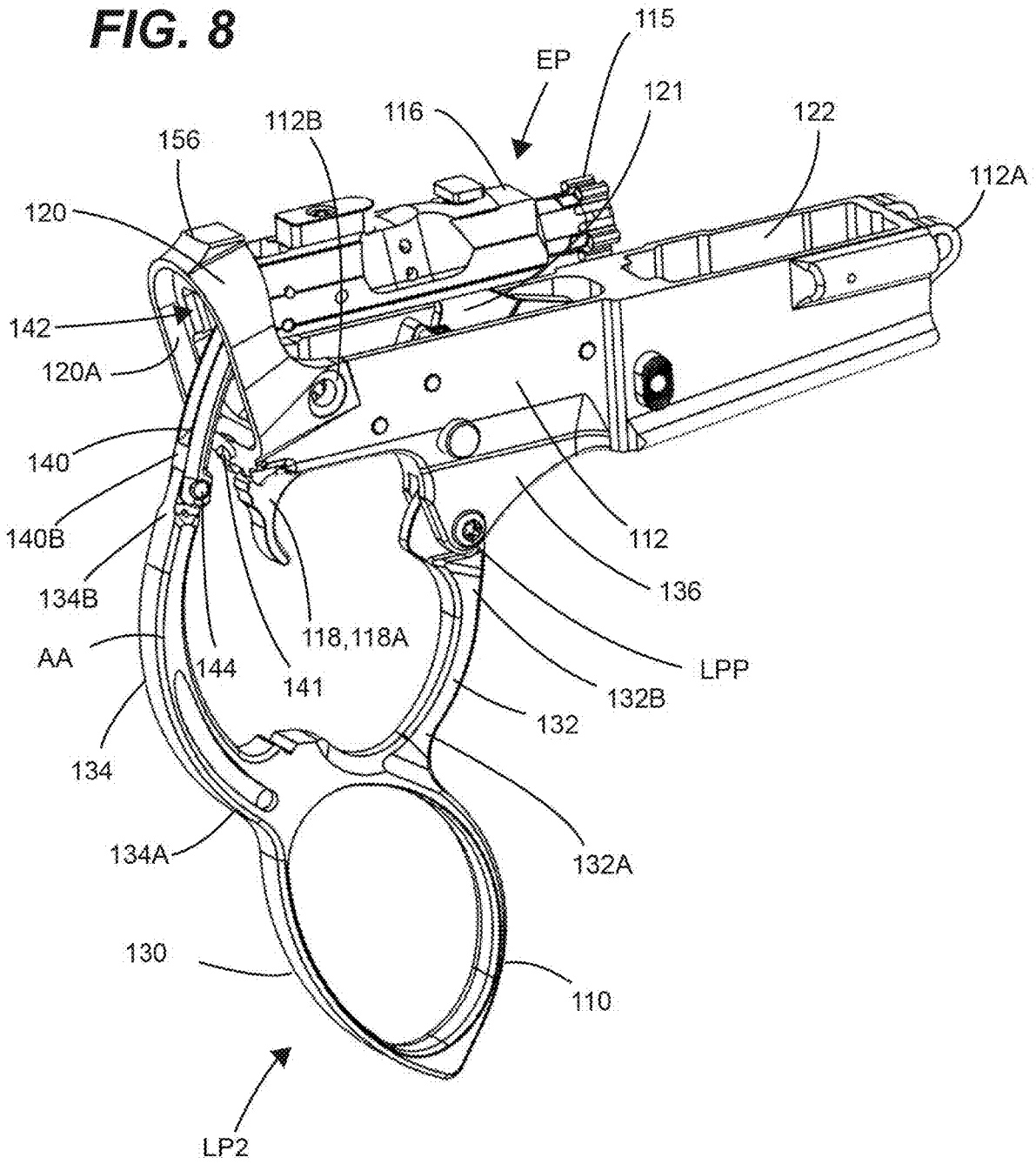
FIG. 8 is a third perspective view showing aspects of the lower receiver body, the carrier group, the linkage member, the action-control lever and the trigger assembly of the rifle of FIG. 1, with the action-control lever thereof in the cartridge-ejecting position.

As best shown in FIGS. 5-9, the action-control lever 110 has a hand loop 130, a first attachment arm 132, and a second attachment arm 134. The first attachment arm 132 has a proximate end portion 132A fixedly attached to (e.g., unitary formed with) the hand loop 130. The second attachment arm 134 has a proximate end portion 134A fixedly attached to the hand loop 130. A distal end portion 132B of the first attachment arm 132 and a lever mounting portion 136 (e.g., a mounting flange) of the lower receiver body 112 are jointly configured to permit the distal end portion 132B of the first attachment arm 132 to be pivotably attached to the lever mounting portion 136 of the lower receiver body 112. Such pivotal attachment enables the hand loop (i.e., the action-control member 110) to pivot between the battery-ready position LP1 and the cartridge-ejecting position LP2. As shown in FIGS. 6 and 7, the action-control lever 110 and the lower receiver body 112 jointly define a fully-enclosed trigger finger window (i.e., space in which the tripper 118A is located) with the action-control lever 110 in the battery-ready position LP1.

Figure 13:
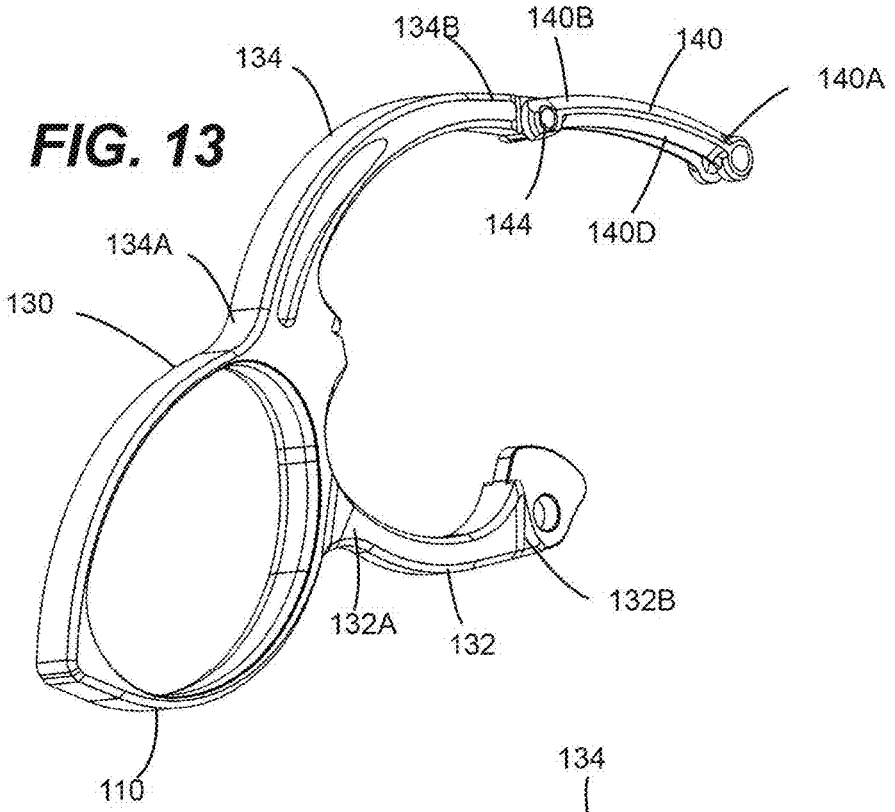
FIG. 13 is a first perspective view showing the action-control lever and the linkage member of the rifle of FIG. 1.
Figure 14:
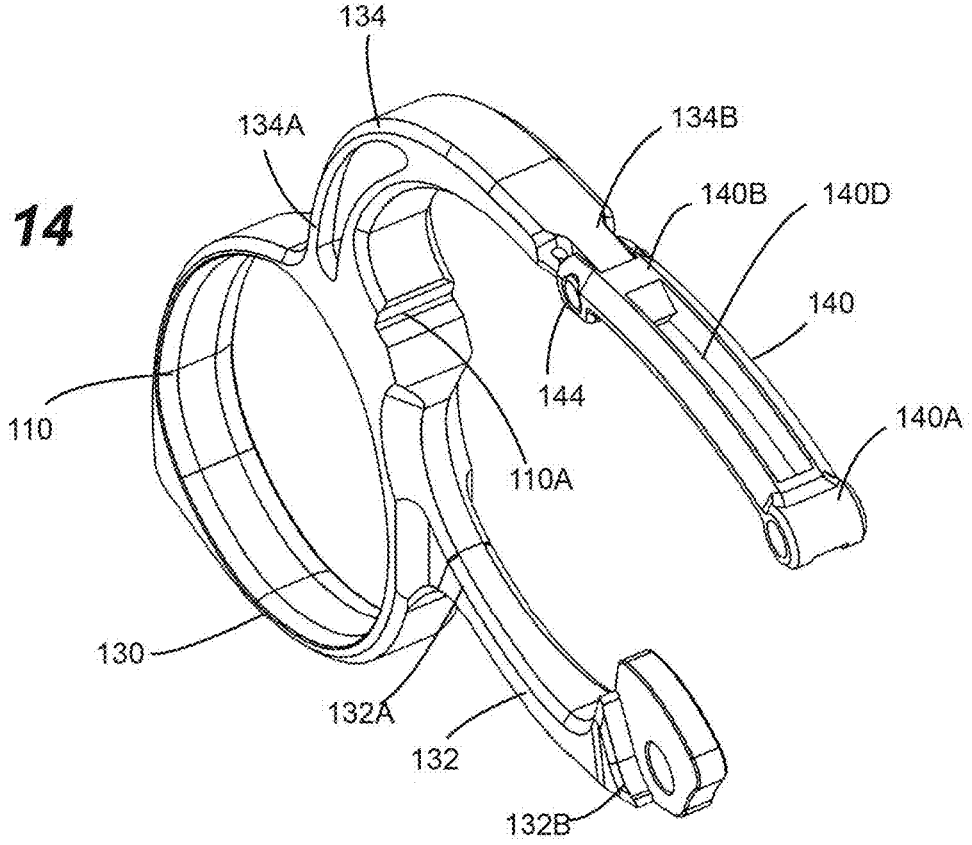
FIG. 14 is a second perspective view showing the action-control lever and the linkage member of the rifle of FIG. 1.

The action-control lever 110 is coupled to the bolt carrier 116 through the second attachment arm 134 and, as most completely shown in FIGS. 13 and 14, a linkage member 140. The linkage member 140 has a first end portion 140A and a second end portion 140B. The first end portion 140A of the linkage member 140 is pivotably attached to a rear end portion 116A of the bolt carrier 116. A distal end portion 134B of the second attachment arm 134 is pivotably attached to the second end portion 140B of the linkage 140. A pin or other suitable type fastening member may be used for providing pivotable connections with the first and second end portions 140A, 140B and respective attached structure. The second attachment arm 134 and the linkage member 140 may thus jointly define a coupling assembly through which the hand loop 130 is coupled to the bolt carrier 116. In these regards, the action-control lever 110 and the linkage member 140 are jointly configured such that pivoting of the hand loop (e.g., the entire action-control member 110) between the battery-ready position LP1 and the cartridge-ejecting position LP2 causes the bolt carrier 116 to correspondingly slide within the bolt carrier receiving bore 119 between a battery position BP and an ejection position EP. The lower receiver body 112 may have a retention member 141 (FIGS. 8 and 9) mounted thereon that is forcibly biased (e.g., spring-biased) into engagement with a mating structure 110A (FIGS. 8 and 14) of the action-control lever 110 (e.g., detent, groove, channel, or the like) for selectively retaining the action-control lever 110 in the battery-ready position LP1 to inhibit the action-control lever 110 from unintentional pivoting away from the battery-ready position LP1.

As best shown in FIGS. 6, 7, and 14, the linkage member 140 includes a hammer-receiving space 140D within a central portion 140C between its first and second end portions 140A, 140B. A head 117A of the firing pin 117 (FIG. 6) is located below the hammer-receiving space 140D. The hammer-receiving space 140D may be any suitable configuration for having an end portion of a hammer 118B (FIGS. 6 and 7) of the trigger assembly 118 disposed therein when the hammer 118B is released to discharge a round of ammunition. Examples of the hammer-receiving space 140D include, but are not limited to, a channel within a lower surface of the linkage member 140 and a passage extending through upper and lower surfaces of the linkage member 140.

The second attachment arm 134 and the lower receiver body 112 are jointly configured such that the second attachment arm 134 extends through a passage 142 of the stock mounting flange 120 with the action-control lever 110 in the battery-ready position LP1. The passage 142 is within a central area of the stock flange 120 and is encompassed by a stock receptacle 120A of the stock mounting flange 120. The stock receptacle 120A receives a receiver engaging portion of a stock. In some embodiments, the stock receptacle 120A is compatible for being matingly engaged with the receiver engaging portion of a stock that is directly mountable on a shotgun (e.g., Remington brand, Winchester brand or Mossberg brand) that was commercially-available prior to the year 2022 AD.

Figure 9:
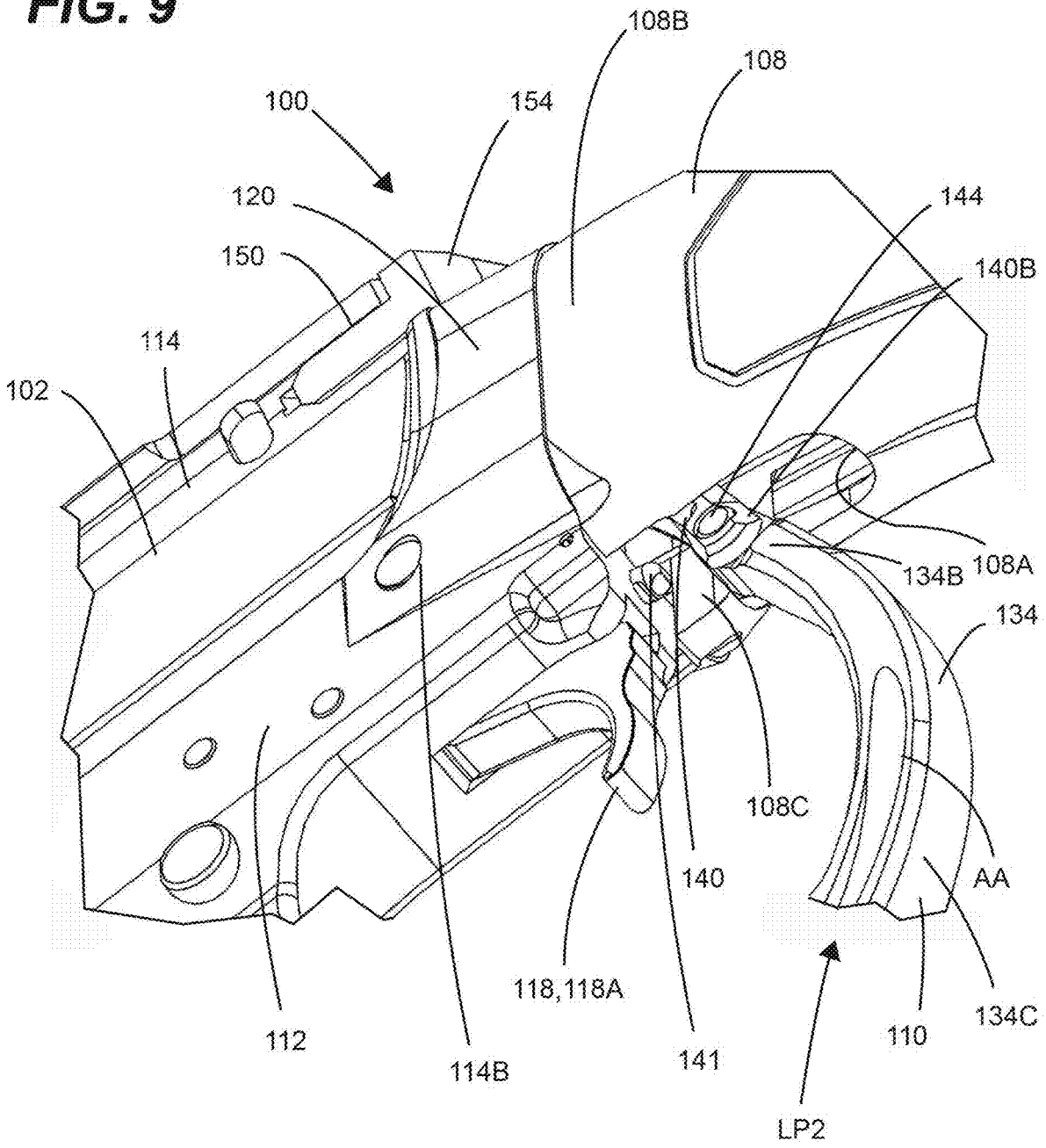
FIG. 9 is an enlarged, partial perspective view of the rifle of FIG. 1, with the action-control lever thereof in the cartridge-ejecting position.

Preferably, the second attachment arm 134 includes an arcuate segment 134C between the distal end portion 134B and the hand loop 130 with the arcuate segment 134C extending along an arcuate axis AA (FIG. 9). All points along the arcuate axis AA are equidistant (approximately or substantially) from the pivot axis PA1 about which the action-control lever 110 pivots between the battery-ready position LP1 and the cartridge-ejecting position LP2. With the hand loop 110 sufficiently moved from the battery-ready position LP1 to the cartridge-ejecting position LP2, the second attachment arm 134 moves out of the passage 142 and the linkage member 140 moves into the passage 142.

In some embodiments, as shown in FIG. 9, the stock 108 may include an attachment arm passage 108A within a bottom surface of its receiver engaging portion 108B. The second attachment arm 134 of the action-control lever 110 extends through the attachment arm passage 108A and through the stock mounting flange 120 with the action-control lever 110 in the battery-ready position LP1. The linkage member 140 may extend through the attachment arm passage 108A and through the stock mounting flange 120 with the action-control lever 110 sufficiently displaced from the battery-ready position LP1 toward the cartridge-ejecting position LP2, with the action-control lever 110 in the cartridge-ejecting position LP2, or both.

Physical and dimensional characteristics of the second attachment arm 134 and the linkage member 140 jointly permit sufficient translation of the bolt carrier 116 between the battery position BP and the ejection position EP for an associated respective amount of pivotal movement of the action-control lever 110 between the battery-ready position LP1 and the cartridge-ejecting position LP2. During such movements of the action-control lever 110 and the carrier 116, the second attachment arm 134 and the linkage member 140 are limited to doing so within the confines of available amount of space within the upper receiver body 114 and within the passage 142 of the stock mounting flange 120. For example, respective lengths, respective curvatures, respective cross-sectional dimensions, or combinations of the second attachment arm 134, the linkage member 140, or both may be specified to achieve a resulting movement characteristic (e.g., displacement magnitude, rate of displacement, etc.) of the carrier 116 for a given amount of pivotal movement of the action-control lever 110 and to correspondingly achieve required spatial positioning of the second attachment arm 134 and the linkage member 140 within the upper receiver body 114 and stock flange 120 during the aforementioned movements of the action-control lever 110 and the carrier 116.

Attachment of the linkage member 140 to the distal end portion 134B of the second attachment arm 134 provides a structure that enables detachment of the lower receiver body 112 and all associated components carried thereby from the upper receiver body 114 and all associated components carried thereby. For example, a pin 144 that pivotably adjoins the second end portion 140B of the linkage member 140 and the distal end portion 134B of the second attachment arm 134 may be removed from (e.g., pressed out of) engagement therewith for permitting separation of the linkage member 140 and the second attachment arm 134. Such separation decouples the only components of the receiver system 102 that connectedly span between the upper and lower receiver bodies 112, 114.

Figure 10:
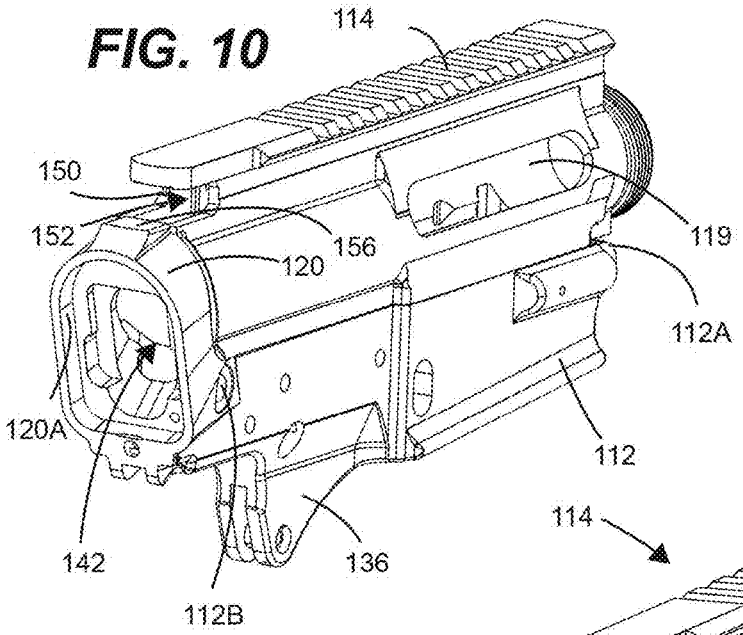
FIG. 10 is a first perspective view showing the receiver system of the rifle of FIG. 1.
Figure 11:
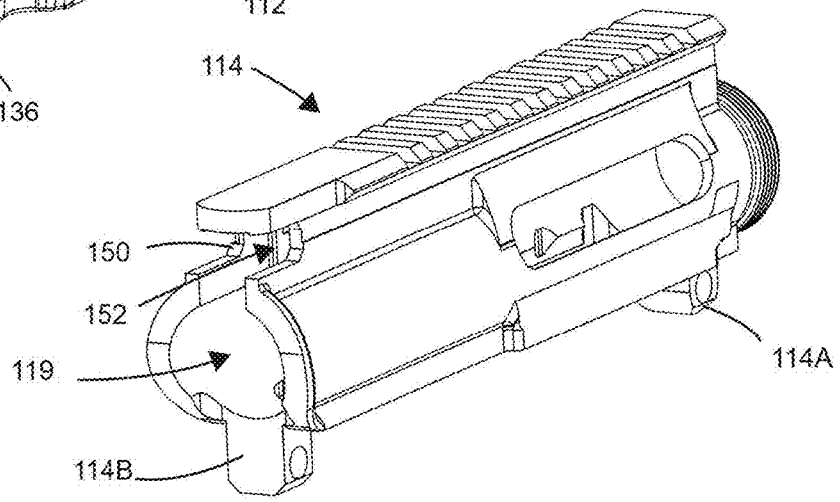
FIG. 11 is a perspective view showing an upper receiver body of the receiver system shown in FIG. 10.
Figure 12:
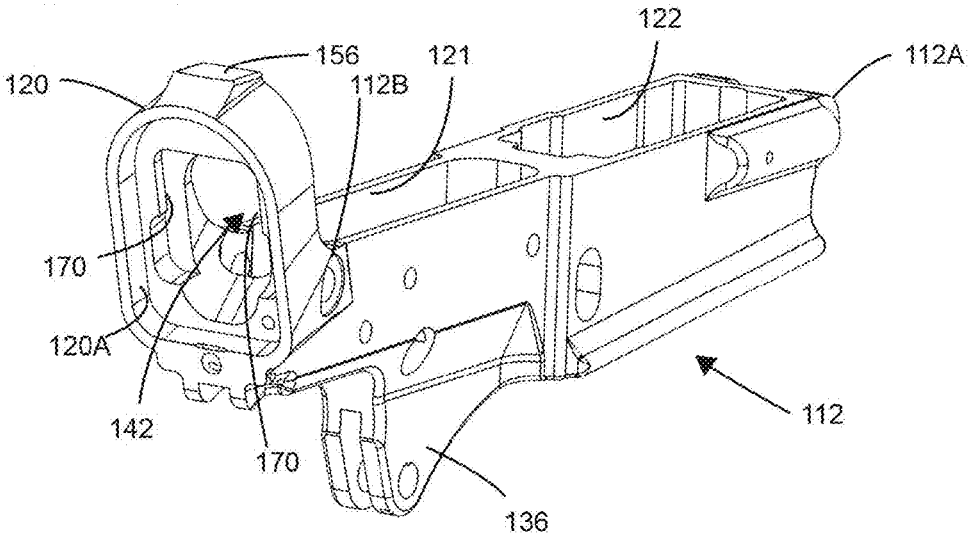
FIG. 12 is a perspective view showing the lower receiver body of the receiver system shown in FIG. 10.

As disclosed above, in some embodiments, the upper receiver body 114 may be an AR-15 platform compatible upper receiver body that was commercially-available prior to the year 2022 AD and the lower receiver body 112 is an AR-15 platform compatible lower receiver that is lever-action specific in accordance with the disclosures made herein. A skilled person will understand that the AR-15 platform compatible upper receiver body has a charging handle in place when used in semi-automatic firearm applications and that the charging handle is used for cycling the bolt of such a semi-automatic firearm from the battery position to the ejection position (i.e., the position causing a chambered cartridge to be ejected). As best seen in FIGS. 9-11, an AR-15 platform compatible upper receiver body includes a charging handle pocket 150 in which a head portion of the charging handle resides and a charging handle passage 152 in which an elongated member portion of the charging handle resides.

When used with a lower receiver body that is lever-action specific in accordance with the disclosures made herein, the aforementioned charging handle may be omitted from the firearm construct. Thus, there is no head portion of the charging handle to reside within the charging handle pocket 150 and no elongated member portion of the charging handle to reside within the charging handle passage 152. In preferred embodiments, a charging handle plug 154 (which may be part of the disclosed receiver system) is secured within the charging handle pocket 150 as a result of the lower and upper receivers 112, 114 being attached to (i.e., engaged with) each other, as best shown in FIGS. 5 and 9. The charging handle plug 154 serves the valuable purposes of limiting external contaminants from entering the firearm through the charging handle passage 152 and limiting gunshot residue during cartridge discharge from escaping to the atmosphere through the charging handle passage 152. The lower receiver body 112 may include a plug engagement body 156 having an engagement surface that engages a mating engagement surface of the charging handle plug 154 to bias the charging handle plug 154 into constrained engagement within the charging handle pocket 150 as a result of the lower and upper receivers 112, 114 being attached to each other. The plug engagement body 156 is preferably integral with the stock mounting flange 120.

Referring now to FIGS. 5, 12, 15, and 16, the receiver system 102 may further include a stock securement body 160. The stock securement body 160 serves to provide a mounting structure attached to the lower receiver body 112 to which a stock fastener 162 may attach for enabling the stock 108 to be fixedly secured to the lower receiver body 112. The stock securement body 160 is preferably attached to the stock mounting flange 120 in a selectively detachable manner, but in a manner in which it is fixedly secured when the stock 108 is fixedly secured to the lower receiver body 112.

The stock securement body 160 includes a first end portion 160A and a second end portion 160B. The first end portion 160A is configured for having the stock fastener 162 engaged therewith and the second end portion 160B is configured for engagement with the stock flange 120. In preferred embodiments, the first end portion 160A has an interlock (e.g., threaded) interface 164 that may be engaged with a mating interlock interface 166 of a stock fastener 162. The second end portion 160B has spaced-apart engagement shoulders 168. The stock mounting flange 120 includes opposing shoulder-receiving receptacles 170 formed by spaced apart wall segments of the stock mounting flange 120 within its central passage 142.

The spaced-apart engagement shoulders 168 and the opposing shoulder-receiving receptacles 170 are jointly configured for permitting each of the spaced-apart engagement shoulders 168 to be engaged within a respective one of the opposing shoulder-receiving receptacles 170 to inhibit unrestricted fore and aft movement of the stock securement body 160 relative to the stock mounting flange 120. For example, the opposing shoulder-receiving receptacles 170 have entry recesses that permit each engagement shoulders 168 to be engaged within the respective one of the opposing shoulder-receiving receptacles 170 by placing each of the spaced-apart engagement shoulders 168 into the respective one of the opposing shoulder-receiving receptacles 170 and then being moved vertically into a slotted portion of the respective one of the opposing shoulder-receiving receptacles 170 to thereby inhibit unrestricted fore and aft movement of the stock securement body 160 relative to the stock mounting flange 120.

The receiver engaging portion 108B of the stock 108 includes a stub 108C that has a mating fit within the stock receptacle 120A of the stock mounting flange 120. This mating fit (e.g., slip fit) fixedly positions the receiver engaging portion 108B of the stock 108 relative to the stock mounting flange 120 (i.e., limits up/down and side-to-side movement of the stub 108C within the stock receptacle 120A). The stock 108 preferably includes a passage in the receiver engaging portion 108B that receives the first end portion 160A of the stock securement body 160 (e.g., an elongated round bore having an inside diameter with a close-tolerance fit (e.g., not more than 0.050") with the outside diameter of the first end portion 160A of the stock securement body 160). Thus, fixed positioning of the receiver engaging portion 108B of the stock 108 relative to the stock receptacle 120A via engagement of the stock fastener 162 with the stock 108 and the stock securement body 160 limits vertical movement of the spaced-apart engagement shoulders 168 relative to the opposing shoulder-receiving receptacles 170 to thereby maintain each spaced-apart engagement shoulder 168 in engagement with the respective one of the opposing shoulder-receiving receptacles 170.

Figure 15:
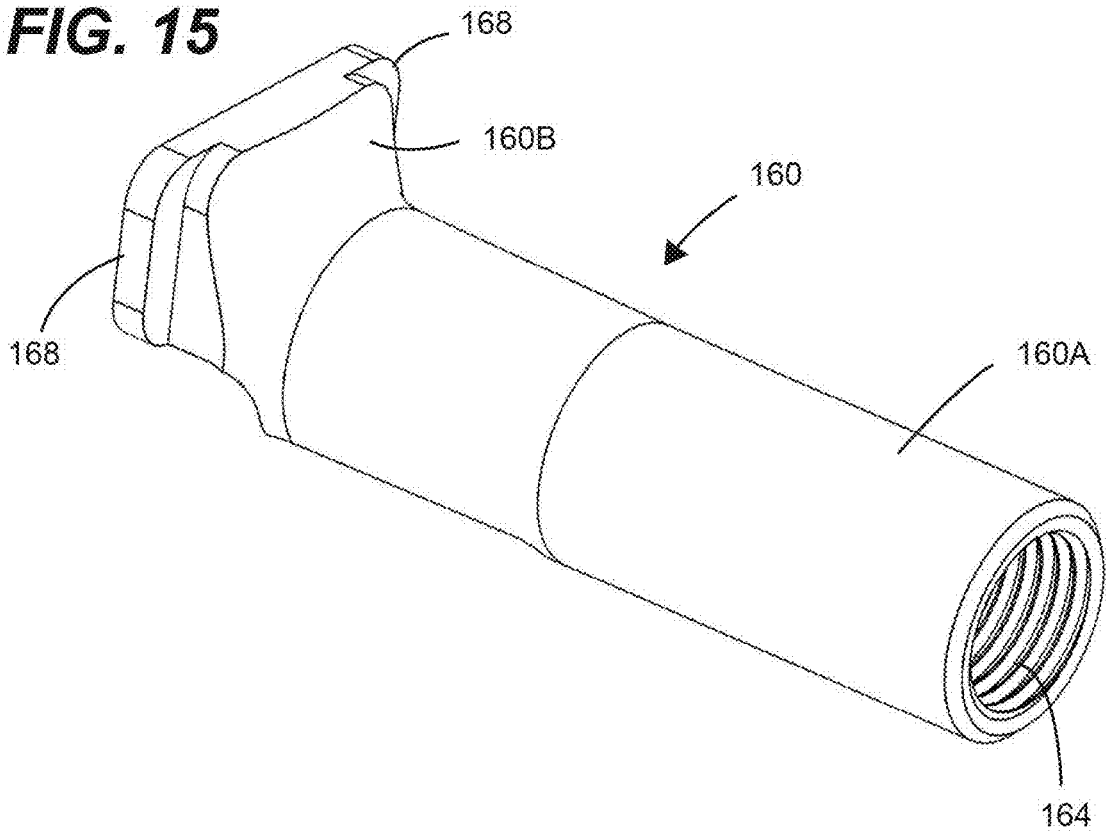
FIG. 15 is a first perspective view showing an accessory securement body of the rifle of FIG. 1.
Figure 16:
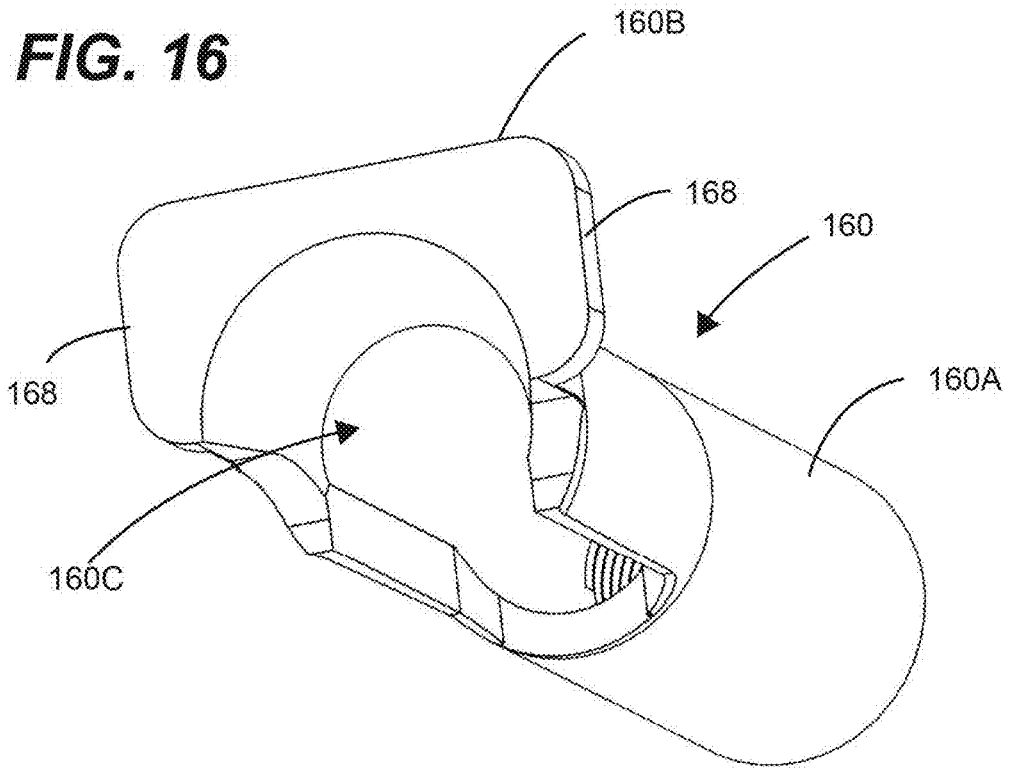
FIG. 16 is a second perspective view showing the accessory securement body of the rifle of FIG. 1.

In some embodiments, as shown in FIGS. 15 and 16, the stock securement body 160 may include an attachment arm passage 160C. The second attachment arm 134 of the action-control lever 110 extends through the attachment arm passage 160C and through the stock mounting flange 120 with the action-control lever 110 in the battery-ready position LP1. The linkage member 140 may extend through the attachment arm passage 160C and through the stock mounting flange 120 with the action-control lever 110 sufficiently displaced from the battery-ready position LP1 toward the cartridge-ejecting position LP2, with the action-control lever 110 in the cartridge-ejecting position LP2, or both.

Although the invention has been described with reference to several exemplary embodiments, it is understood that the words that have been used are words of description and illustration, rather than words of limitation. Changes may be made within the purview of the appended claims, as presently stated and as amended, without departing from the scope and spirit of the invention in all its aspects. Although the invention has been described with reference to particular means, materials and embodiments, the invention is not intended to be limited to the particulars disclosed; rather, the invention extends to all functionally equivalent technologies, structures, methods and uses such as are within the scope of the appended claims.

What is claimed is:

1. A firearm, comprising:

at least one receiver body, wherein the at least one receiver body includes a bolt carrier receiving bore and an accessory mounting flange;

a bolt carrier slidably disposed within the bolt carrier receiving bore;

a linkage member having a first end portion and a second end portion, wherein the first end portion is pivotably attached to the bolt carrier, wherein a central portion of the linkage member between the first and second end portions thereof has a hammer-receiving space therein; and an action-control lever having a first attachment arm and a second attachment arm, wherein a proximate end portion of the first attachment arm is attached to a proximate end portion of the second attachment arm, wherein a distal end portion of the first attachment arm is pivotably attached to the at least one receiver body for enabling the action-control lever to pivot between a battery-ready position and a cartridge-ejecting position, wherein the second attachment arm extends through the accessory mounting flange with the action-control lever in the battery-ready position, and wherein a distal end portion of the second attachment arm is attached to the second end portion of the linkage member.

2. The firearm of claim 1, further comprising:

a bolt carried by the bolt carrier; and a firing pin slidably disposed within a mating passage of the bolt;

wherein a head of the firing pin is located below the hammer-receiving space.

3. The firearm of claim 2 wherein the hammer-receiving space is one of a hammer-receiving channel within a lower surface of the linkage member and a hammer-receiving passage extending through upper and lower surfaces of the linkage member.

4. The firearm of claim 1, further comprising:

an accessory securement body attached to the accessory mounting flange.

5. The firearm of claim 4, further comprising:

an accessory engaged with the accessory securement body and the accessory mounting flange;

wherein the accessory includes a receiver engaging portion at an end thereof; and wherein the receiver engaging portion of the accessory is engaged with the accessory mounting flange.

6. The firearm of claim 1 wherein:

the second attachment arm includes an arcuate segment;

the arcuate segment extends along an arcuate axis; and a plurality of points along the arcuate axis are equidistant from a pivot axis about which the action-control lever pivots between the battery-ready position and the cartridge-ejecting position.

7. The firearm of claim 6, further comprising:

a bolt carried by the bolt carrier;

a firing pin slidably disposed within a mating passage of the bolt;

wherein a head of the firing pin is located below the hammer-receiving space; and wherein the hammer-receiving space is one of a hammer-receiving channel within a lower surface of the linkage member and a hammer-receiving passage extending through upper and lower surfaces of the linkage member.

8. The firearm of claim 1, further comprising:

a trigger assembly;

the at least one receiver body includes an upper receiver body and a lower receiver body;

the upper receiver body is an AR-15 platform compatible upper receiver body;

the bolt carrier receiving bore is within the upper receiver body;

the trigger assembly is integral with the lower receiver body; and the trigger assembly and the lower receiver body are jointly configured such that a trigger of the trigger assembly is located under the accessory mounting flange of the lower receiver body.

9. The firearm of claim 8, further comprising:

a bolt carried by the bolt carrier; and a firing pin slidably disposed within a mating passage of the bolt;

wherein a head of the firing pin is located below the hammer-receiving space.

10. The firearm of claim 9, further comprising:

an accessory securement body attached to the accessory mounting flange;

wherein the accessory securement body has spaced-apart engagement shoulders;

wherein the accessory mounting flange includes opposing shoulder-receiving receptacles within a central passage thereof; and wherein the spaced-apart engagement shoulders and the opposing shoulder-receiving receptacles are jointly configured for permitting each of the spaced-apart engagement shoulders to be engaged within a respective one of the opposing shoulder-receiving receptacles to inhibit unrestricted fore and aft movement of the accessory securement body relative to the lower receiver body.

11. The firearm of claim 1 wherein the hammer-receiving space is one of a hammer-receiving channel within a lower surface of the linkage member and a hammer-receiving passage extending through upper and lower surfaces of the linkage member.

12. The firearm of claim 11, further comprising:

an accessory securement body attached to the accessory mounting flange.

13. The firearm of claim 12, further comprising:

an accessory engaged with the accessory securement body and the accessory mounting flange;

wherein the accessory includes a receiver engaging portion at an end thereof, and wherein the receiver engaging portion of the accessory is engaged with the accessory mounting flange.

14. The firearm of claim 13 wherein:

the second attachment arm includes an arcuate segment;

the arcuate segment extends along an arcuate axis; and a plurality of points along the arcuate axis are equidistant from a pivot axis about which the action-control lever pivots between the battery-ready position and the cartridge-ejecting position.

15. The firearm of claim 14, further comprising:

a bolt carried by the bolt carrier;

a firing pin slidably disposed within a mating passage of the bolt;

wherein a head of the firing pin is located below the hammer-receiving space.

16. The firearm of claim 14, further comprising:

a trigger assembly;

the at least one receiver body includes an upper receiver body and a lower receiver body;

the bolt carrier receiving bore is within the upper receiver body;

the trigger assembly is integral with the lower receiver body; and the trigger assembly and the lower receiver body are jointly configured such that a trigger of the trigger assembly is located under the accessory mounting flange.

17. The firearm of claim 16, further comprising:

a bolt carried by the bolt carrier; and a firing pin slidably disposed within a mating passage of the bolt;

wherein a head of the firing pin is located below the hammer-receiving space.

18. The firearm of claim 17, wherein:

the accessory securement body has spaced-apart engagement shoulders;

the accessory mounting flange includes opposing shoulder-receiving receptacles within a central passage thereof; and the spaced-apart engagement shoulders and the opposing shoulder-receiving receptacles are jointly configured for permitting each of the spaced-apart engagement shoulders to be engaged within a respective one of the opposing shoulder-receiving receptacles to inhibit unrestricted fore and aft movement of the accessory securement body relative to the lower receiver body.

19. The firearm of claim 1, further comprising:

a trigger assembly;

wherein the at least one receiver body includes an upper receiver body and a lower receiver body;

wherein the bolt carrier receiving bore is within the upper receiver body; and wherein the trigger assembly is integral with the lower receiver body.

20. The firearm of claim 19, further comprising:

an accessory securement body attached to the accessory mounting flange; and an accessory engaged with the accessory securement body and the accessory mounting flange;

wherein the accessory includes a receiver engaging portion at an end thereof; and wherein the receiver engaging portion of the accessory is engaged with the accessory mounting flange.

21. The firearm of claim 20, further comprising:

a bolt carried by the bolt carrier; and a firing pin slidably disposed within a mating passage of the bolt;

wherein a head of the firing pin is located below the hammer-receiving space.

22. The firearm of claim 20 wherein:

the second attachment arm includes an arcuate segment;

the arcuate segment extends along an arcuate axis; and a plurality of points along the arcuate axis are equidistant from a pivot axis about which the action-control lever pivots between the battery-ready position and the cartridge-ejecting position.

23. The firearm of claim 19 wherein:

the second attachment arm includes an arcuate segment;

the arcuate segment extends along an arcuate axis; and a plurality of points along the arcuate axis are equidistant from a pivot axis about which the action-control lever pivots between the battery-ready position and the cartridge-ejecting position.

24. The firearm of claim 1, further comprising:

a trigger assembly;

the at least one receiver body includes an upper receiver body and a lower receiver body; and a trigger of the trigger assembly is located under the accessory mounting flange.

25. The firearm of claim 24, further comprising:

an accessory securement body attached to the accessory mounting flange; and an accessory engaged with the accessory securement body and the accessory mounting flange;

wherein the accessory includes a receiver engaging portion at an end thereof, and wherein the receiver engaging portion of the accessory is engaged with the accessory mounting flange.

26. The firearm of claim 25, further comprising:

a bolt carried by the bolt carrier; and a firing pin slidably disposed within a mating passage of the bolt;

wherein a head of the firing pin is located below the hammer-receiving space.

27. The firearm of claim 25 wherein:

the second attachment arm includes an arcuate segment;

the arcuate segment extends along an arcuate axis; and a plurality of points along the arcuate axis are equidistant from a pivot axis about which the action-control lever pivots between the battery-ready position and the cartridge-ejecting position.

28. The firearm of claim 1, further comprising:

an accessory securement body attached to the accessory mounting flange;

wherein the at least one receiver body includes an upper receiver body and a lower receiver body;

wherein the upper receiver body is an AR-15 platform compatible upper receiver body;

wherein the accessory securement body has spaced-apart engagement shoulders;

wherein the accessory mounting flange includes opposing shoulder-receiving receptacles within a central passage thereof; and wherein the spaced-apart engagement shoulders and the opposing shoulder-receiving receptacles are jointly configured for permitting each of the spaced-apart engagement shoulders to be engaged within a respective one of the opposing shoulder-receiving receptacles to inhibit unrestricted fore and aft movement of the accessory securement body relative to the lower receiver body.

29. The firearm of claim 28, further comprising:

a trigger assembly, wherein a trigger of the trigger assembly is located under the accessory mounting flange.

30. The firearm of claim 29 wherein:

the second attachment arm includes an arcuate segment;

the arcuate segment extends along an arcuate axis; and a plurality of points along the arcuate axis are equidistant from a pivot axis about which the action-control lever pivots between the battery-ready position and the cartridge-ejecting position.

31. The firearm of claim 28 wherein:

the second attachment arm includes an arcuate segment;

the arcuate segment extends along an arcuate axis; and a plurality of points along the arcuate axis are equidistant from a pivot axis about which the action-control lever pivots between the battery-ready position and the cartridge-ejecting position.

* * * * *